United States Patent [19]

Haddad

[11] 4,099,716

[45] Jul. 11, 1978

[54] GAME RACKET

[75] Inventor: Daniel G. Haddad, Worcester, Mass.

[73] Assignee: Norman S. Blodgett, Worcester, Mass. ; a part interest

[21] Appl. No.: 712,703

[22] Filed: Aug. 9, 1976

Related U.S. Application Data

[63] Continuation of Ser. No. 605,167, Aug. 15, 1975, abandoned, which is a continuation of Ser. No. 437,166, Jan. 28, 1974, abandoned.

[51] Int. Cl.[2] ..... A63B 51/12

[52] U.S. Cl. ..... 273/73 E

[58] Field of Search ..... 273/73 R, 73 C, 73 D, 273/73 E, 73 G, 73 H, 73 J

[56] References Cited

U.S. PATENT DOCUMENTS

| | | | |
|---|---|---|---|
| 294,271 | 2/1884 | Reach | 273/73 E |
| 1,452,803 | 4/1923 | Harris | 273/73 H |
| 1,476,906 | 12/1923 | Maria | 273/73 E |
| 1,524,826 | 2/1925 | Icke et al. | 273/73 H |
| 1,562,881 | 11/1925 | Gower et al. | 273/73 H |
| 1,588,139 | 6/1926 | Penney | 273/73 H |
| 1,618,727 | 2/1927 | Reach | 273/73 H |
| 3,206,203 | 9/1965 | Lacoste | 273/73 H |
| 3,540,728 | 11/1970 | Palmer | 273/73 H |
| 3,612,526 | 10/1971 | Brull | 273/73 H X |
| 3,642,283 | 2/1972 | Wilkens | 273/73 G |

FOREIGN PATENT DOCUMENTS

| | | | |
|---|---|---|---|
| 17,228 of | 7/1929 | Australia | 273/73 G |
| 122,823 | 11/1946 | Australia | 273/73 H |
| 409,075 | 2/1910 | France | 273/73 E |
| 2,049,750 | 5/1972 | Fed. Rep. of Germany | 273/73 E |
| 2,323,297 | 11/1973 | Fed. Rep. of Germany | 273/73 E |
| 2,438,807 | 3/1975 | Fed. Rep. of Germany | 273/73 E |
| 2,647 of | 1880 | United Kingdom | 273/73 E |
| 28,838 of | 12/1902 | United Kingdom | 273/73 E |
| 4,305 of | 1914 | United Kingdom | 273/73 E |
| 178,694 | 4/1922 | United Kingdom | 273/73 J |
| 247,773 | 2/1926 | United Kingdom | 273/73 E |

*Primary Examiner*—Richard J. Apley

*Attorney, Agent, or Firm*—Norman S. Blodgett; Gerry A. Biodgett

[57] ABSTRACT

A game racket having a string net, the tension of the strings in the net being easily adjustable. The racket has a handle, a hoop attached to the handle, and strings forming a net across the hoop. A wedge located in the hoop and having longitudinal central strings attached thereto, the wedge being drawn by a threaded rod toward the handle to cause an increase in the peripheral dimension of the hoop and thereby a tightening of the strings and an equalization of tension throughout the net.

8 Claims, 5 Drawing Figures

GAME RACKET

This is a continuation, of application Ser. No. 605,167 which was filed on Aug. 15, 1975, now abandoned, which was a continuation of application Ser. No. 437,166 filed Jan. 28, 1974, now abandoned.

BACKGROUND OF THE INVENTION

The use of a strung racket for striking a small, more-or-less resilient object is a common element in many popular games, including tennis, squash, paddle ball, and badminton. The tension in the strings which make up the net of the racket is an important factor in the performance in the racket. In a normal racket, the tension of the strings is set when the strings are placed on the racket and any subsequent adjustment requires considerable time and skill. Because the desired tension varies considerably, depending on the game conditions, a player who is serious about his performance must maintain several rackets. In addition to this problem of the initial tension setting, there is also a tendency for the tension of the strings to change unpredictably with changes in humidity, etc. Both of these problems have been recognized and various solutions proposed to allow on the spot adjustment of a single racket to any desired tension.

An early attempt involved the idea of placing a pneumatically inflatable tube outside the hoop portion of the frame. Because the strings were supported by the external peripheral surface, inflation of the tube would result in a tightening of the strings. The inflation would be carried out using a pump in the handle of the racket. This device was quite complex and, therefore, expensive and was prone to failure of the components. Another concept was to carry the strings which were parallel to the handle, down into the handle and to draw on the strings using a screw and nut arrangement within the handle. Although this structure was quite complex, and considerably more difficult to string than a regular racket, the racket did involve the useful concept that by drawing on the major axis of the eliptical hoop, the minor axis would increase, thus tightening the strings parallel to it. A winch mounted in the handle for drawing the strings could be used to accomplish the same result. In still another construction, the concept of the pneumatic tube on the external periphery of the hoop is carried out using a cable with hooks which capture the outermost ends of the string and draw the strings tight when the cable is drawn toward the handle. All of these structures involve disadvantages which center around the concept that such complex arrangements are expensive to manufacture and difficult to make strong enough to endure the stresses involved in use. These and other difficulties experienced with the prior art devices have been obviated in a novel manner by the present invention.

It is, therefore, an outstanding object of the invention to provide a game racket in which the tension of the strings can be easily adjusted.

Another object of the invention is the provision of a game racket in which the string tightening mechanism is of simple rugged construction.

A further object of the present invention is the provision of a game racket in which the adjusted tension of the strings is uniform over the surface of the net.

It is another object of the instant invention to provide a game racket in which the string tightening device does not detract from the appearance of the racket.

A still further object of the invention is the provision of a game racket having a string tightening adjustment means which does not interfere with the other functional design features of the racket.

It is a further object of the invention to provide a game racket which is both simple and inexpensive to manufacture and which is capable of a long and useful life with a minimum maintenance.

With these and other objects in view, as will be apparent to those skilled in the art, the invention resides in the combination of parts set forth in the specification and covered by the claims appended hereto.

SUMMARY OF THE INVENTION

In general, the invention involves a game racket having an elongated handle, having a frame attached to one end of the handle, having an eliptical hoop formed by a portion of the frame, and having a string net suspended across the hoop. A tightening means is provided to adjust the tension of the strings in the net by changing the length of the interior peripheral dimension of the hoop. This changing of the internal peripheral dimension of the hoop is accomplished by moving a wedge-shaped element with respect to the handle. The wedge is positioned at a point on the frame where two opposed elements of the frame nearly converge, so that the movement of the wedge changes the separation of the elements.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
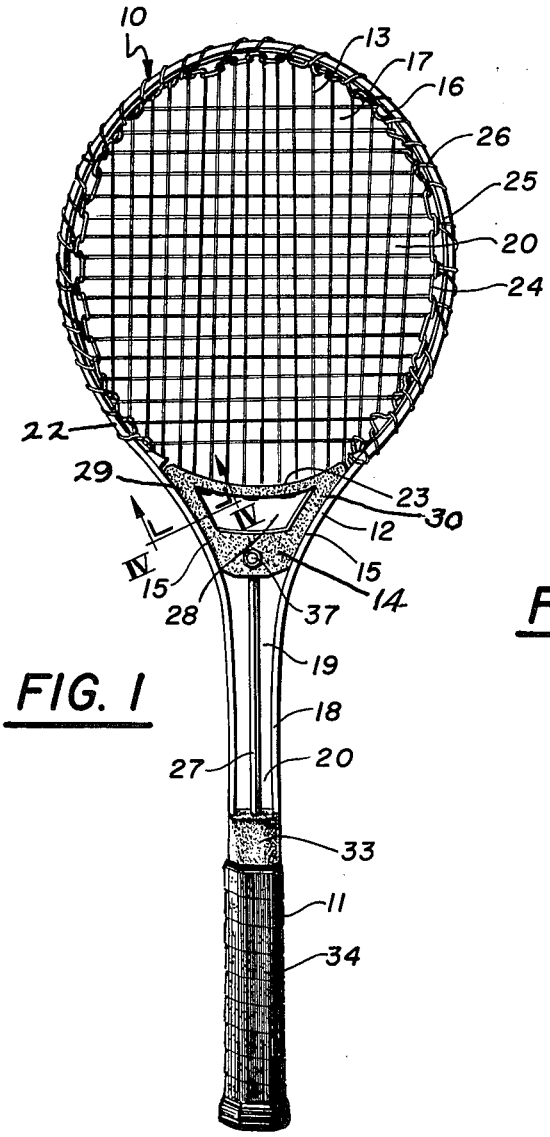
FIG. 1 is a front elevational view of a game racket embodying the principles of the present invention.

Referring first to FIG. 1, in which the general features of the present invention are best shown, the game racket, generally denoted by the numeral 10, is shown to include a handle 11, a metal frame 12, string 13, and a wedge 14. The wedge 14 contacts the frame at two wedge points 15 which may involve point, line, or surface contact. The wedge points 15 divide the frame into a first portion 16 which with the wedge 14 define a wide area 17 and a second portion 18, which with the wedge defines a narrow area 19. Thus, both portions of the frame 12 define a closed geometric figure 20 comprised of the wide area 17, the narrow area 19, and the area of wedge. The portions of the frame between the first portion 16 and the second portion 18 constitute a divergent throat in which the wedge resides and makes contact at the wedge points, the exact location of the wedge points depending on the location of the wedge.

The string 13 is interwoven to form a web or net 21 which is, in turn, peripherally supported by a hoop 22. In the present embodiment the hoop 22 is formed of the first portion 16 of the frame 12 and the curved edge 23 of the wedge 14. The string 13 is actually connected to the frame 12 by means of a wire 24 of sinuous shape having a series of peaks 25. Some of the peaks 25 are attached to the frame 12 by suitable means such as, binding wire 26 and the other peaks 25 are used as eyes or string points for the string 13. In this embodiment of the invention, the strings are also attached to holes in the curved surface 23 of the wedge 14. As a result, a hoop is formed with the string supported on the interior peripheral edge or dimension of the hoop.

The narrow area 19 has at its first end the wedge 14 and at its second edge the handle 11. Connected to the wedge 14 and extending across the narrow area 19 and into the handle 11 is a rod 27.

Figure 4:
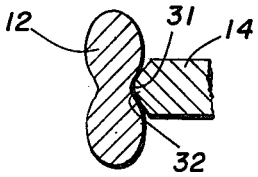
FIG. 4 is a sectional view of the invention as seen along the line IV—IV of FIG. 1.
Figure 5:
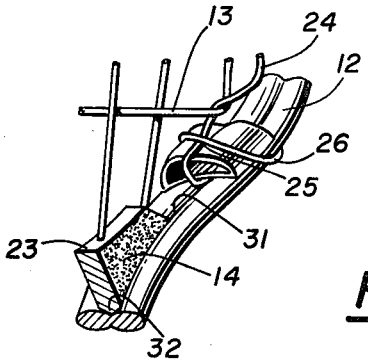
FIG. 5 is a partially sectioned view of the invention shown in FIG. 1.

The wedge 14 is formed of a flat piece of aluminum with a central opening 28 to reduce wind drag. The wedge has a first concave curved edge 29 and a second concave curved edge 30 which engage the frame 12 at wedge points 15. The contact between the wedge and the frame is best shown in FIG. 4. The cross-section of the frame is shown as similar to a figure 8. This shape not only provides a convenient groove 31, but also gives the frame the characteristic that it is more flexible for movement in the plane of the geometric figure than for movement out of the plane of the geometric figure. The wedge 14 is shown as having a ridge 32 which extends along the length of each of the curved edges 29 and 30 and allows sliding linear movement. As is evident in FIG. 4, the wedge is substantially thinner than the frame, so that there is less likelihood of interference with the ball during play and so that it contributes as little as possible to the weight of the racket. A third concave curved edge 23 forms a portion of the interior peripheral dimension of the loop. This arrangement is further shown in FIG. 5.

Figure 2:
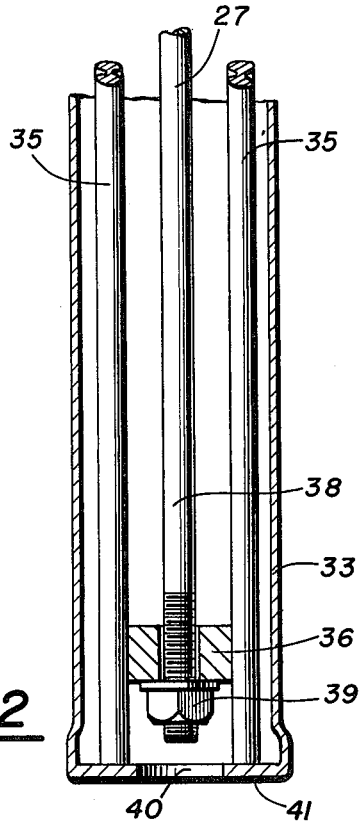
FIG. 2 is a sectional view of the interior of the handle as seen along the line II—II of FIG. 3.
Figure 3:
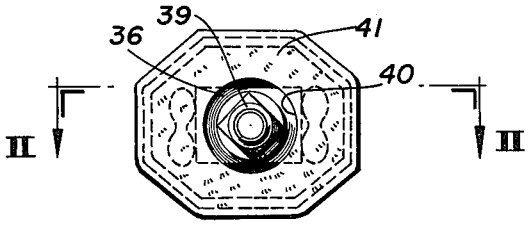
FIG. 3 is a bottom view of the handle portion of the invention shown in FIG. 1.

The handle 11 is an elongated hollow structure formed by extending the parallel extensions 35 of the frame downward, bridging the space between the elements with handle plates 33, and then wrapping the result in leather to form a grip 34. The frame extensions 35 which lie within the handle are clearly shown in FIG. 2. Welded between the frame extensions is an anchor plate 36 through which the rod 27 slides. The wedge end 37 of the rod 27 is attached to the wedge 14 in such a manner that the rod is not rotatable about its length. The handle end 38 of the rod 27 is threaded and has a nut 39 outboard of the anchor plate 36. Access to the nut 39 for a socket wrench is provided by aperture 40 on the bottom surface 41 of the handle. The bottom surface 41 of the handle and the aperture 40 are shown in FIG. 3.

The use and operation of the invention will now be readily understood in view of the above description. The string 13 is first placed on the hoop by weaving it back and forth in the well-known manner between the string points or eyes. The wedge should be located as far away from the handle as possible and the string initially set with a reasonable low tension. Once the string is in place, the nut 39 is turned, causing the wedge 14 to move toward the handle. This motion of the wedge will tighten the strings in two ways. First, the fact that the wedge is moving further away from the section of the frame across the hoop from it will cause an increase in tension on those strings attached to the wedge. In addition, the movement of the wedge toward the handle will cause those portions of the frame which are in contact with the wedge to move apart, thus increasing the dimension of the hoop transversely of the length of the handle. The result of these two movements is a change in the internal peripheral dimension of the hoop which will cause the strings to become more taut. The manner in which the string is attached to the string points of the frame allow the tension to be uniformly distributed over the net. Thus, by turning the nut 39, the tension on the net can easily and simply be increased or decreased as desired.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A game racket comprising:

a an elongated handle having a hollow interior, b a frame connected to the handle, the frame defining and being peripheral to a closed geometric figure and being divided into a first and a second portion by two wedge points separating the first portion from the second portion, the frame at least in the neighborhood of the wedge points having inwardly facing grooves, the frame having string points and a dimension perpendicular to the plane of the geometric figure which is larger than the wedge thickness perpendicular to the plane of the geometric figure, the second portion consisting of two generally-parallel legs which pass longitudinally into and through the handle and are fixedly connected to each other by a transverse anchor plate at the end thereof farthest away from the wedge point, c a wedge having exterior ridges for contacting said grooves in a sliding relationship therewith, said wedge separating the geometric figure into a wide area defined by the wedge and the first portion of the frame, and a narrow area defined by the wedge and the second portion of the frame, the narrow area having a first end and a second end, with the wedge positioned at the first end and the handle position at the second end, d means including a rod connected at one end to the anchor plate and at the other end by the wedge for causing said ridges to slide within the grooves of said frame and drawing the wedge toward the handle, thereby causing the wedge points to move apart, and e a string connected between string points on the frame and across the wide area and to the wedge, so that the string becomes more taut as the wedge points move apart and the tension in the string equalizes throughout the racket because of the string points.

2. A game racket as recited in claim 1, wherein the wedge engages the frame at a first surface and a second surface, the two surfaces being spaced from one another the spacing becoming progressively smaller toward the handle.

3. A game racket as recited in claim 2, wherein the movement between the wedge and each surface is restricted to movement in the plane of the geometric figure.

4. A game racket as recited in claim 1, wherein the said drawing means includes a threaded rod connected between the handle and the wedge and includes a nut held and rotatable within the handle.

5. A game racket as recited in claim 3, wherein access to the nut is achieved through an aperture in the handle.

6. A game racket as recited in claim 5, wherein the wedge has a first and a second curved edge that contact the frame and a third curved edge to which string is attached and which lies adjacent the wide area.

7. A game racket as recited in claim 6, wherein the frame is formed of a structure which is more flexible in movement parallel to the plane of the geometric figure than in movement non-parallel to the plane.

8. A game racket as recited in claim 7, wherein the frame is formed of a solid extrusion of light metal whose cross-section is a generally Figure-8 configuration with no discontinuity to provide sharp edges.

* * * * *